United States Patent [19]

Weatherly

[11] 4,318,523

[45] Mar. 9, 1982

[54] REMOVABLE UTILITY SUPPORT DEVICE FOR LADDER

[75] Inventor: Michael A. Weatherly, Houston, Tex.

[73] Assignee: Howard E. Stuller, Houston, Tex.

[21] Appl. No.: 201,250

[22] Filed: Oct. 27, 1980

[51] Int. Cl.[3] ..... E06C 7/14

[52] U.S. Cl. ..... 248/210; 182/116

[58] Field of Search ..... 248/210, 211, 238; 182/121, 122

[56] References Cited

U.S. PATENT DOCUMENTS

| | | | |
|---|---|---|---|
| 1,246,140 | 11/1917 | Moritz | 248/211 |
| 1,305,922 | 6/1919 | Moller | 248/238 X |
| 2,174,891 | 10/1939 | Maran . | |
| 2,498,944 | 2/1950 | Dyer . | |
| 3,001,751 | 9/1961 | Bozik | 248/210 |
| 3,009,677 | 11/1961 | Munnikhuysen . | |
| 3,111,297 | 11/1963 | Conner . | |
| 3,160,383 | 12/1964 | Lamm | 248/211 |
| 3,220,682 | 11/1965 | Hannon | 248/211 |
| 3,223,369 | 12/1965 | Benninger, Jr. . | |
| 3,326,507 | 6/1967 | Sears | 248/238 |
| 3,495,683 | 2/1970 | Broden | 248/210 X |
| 3,809,351 | 5/1974 | Bravo et al. . | |
| 3,822,846 | 7/1974 | Jesionowski . | |
| 3,822,847 | 7/1974 | Emmons . | |
| 3,985,203 | 10/1976 | Erlenbach . | |
| 4,099,693 | 7/1978 | Blann . | |

FOREIGN PATENT DOCUMENTS

| | | | |
|---|---|---|---|
| 56495 | 4/1936 | Norway | 248/238 |
| 386047 | 1/1933 | United Kingdom | 248/211 |

*Primary Examiner*—J. Franklin Foss

*Attorney, Agent, or Firm*—Pravel, Gambrell, Hewitt, Kirk, Kimball & Dodge

[57] ABSTRACT

A utility support device for use in conjunction with hollow-rung ladders is provided which derives support from studs inserted into the hollow rungs of the ladder. The device is easily mounted to either side of the ladder for ease of access and convenience of the user. The device is suitable for supporting tools, materials and the like and may be easily relocated from one position on the ladder to another. The device is adjustable to accommodate different rung spacings, as well as to allow maintenance of substantially horizontal support through varying angles of inclination of the ladder.

9 Claims, 6 Drawing Figures

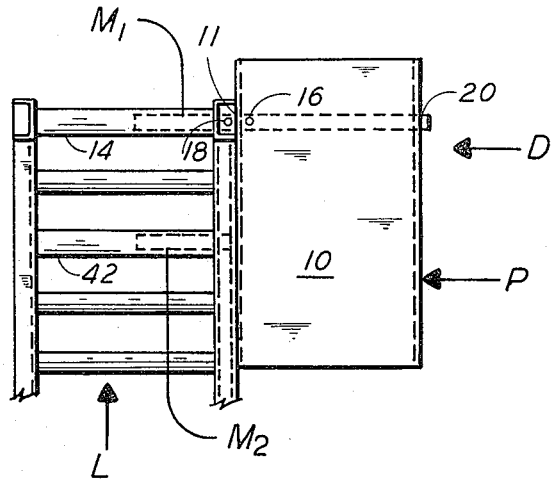
FIG. 2
FIG. 1
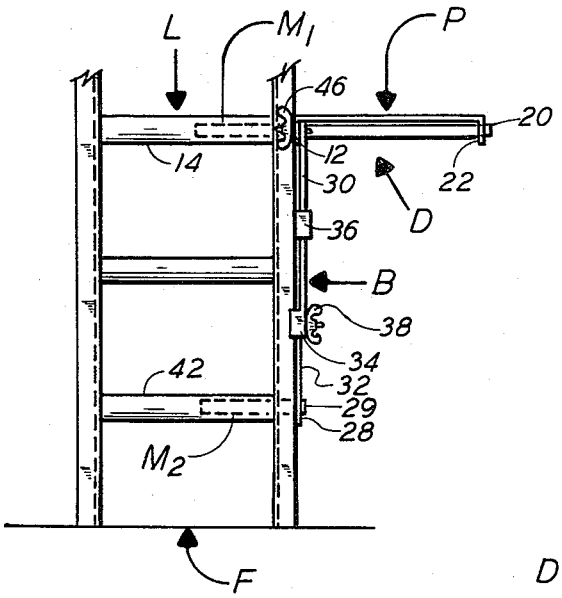
FIG. 3
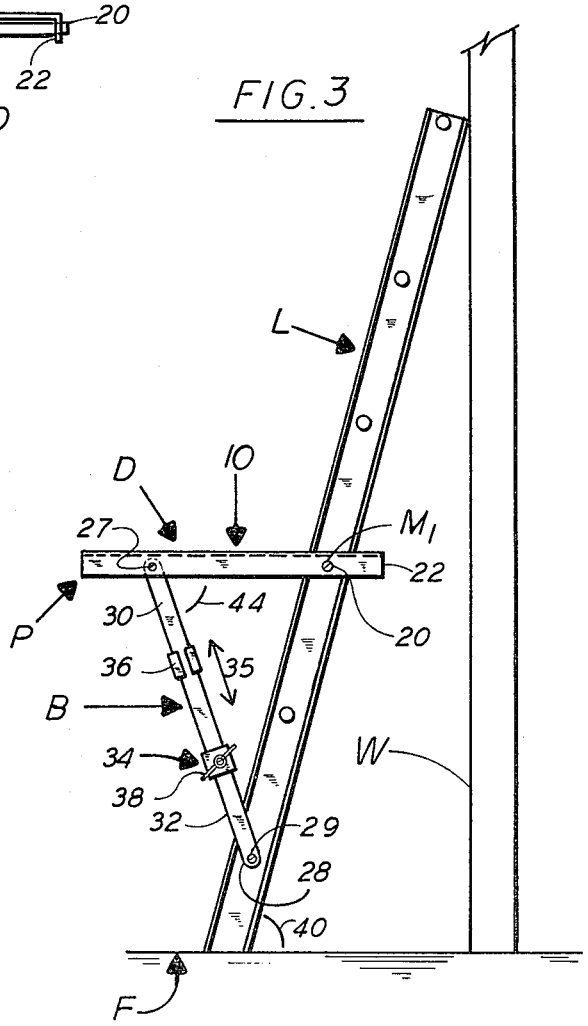

REMOVABLE UTILITY SUPPORT DEVICE FOR LADDER

BACKGROUND OF THE INVENTION

1. Field of the Invention

The present invention relates to utility support devices for use with ladders.

2. Description of the Prior Art

U.S. Pat. Nos. 2,174,891; 2,498,944; 3,009,677; 3,111,297; 3,223,369; 3,809,351; 3,822,846; 3,822,847; 3,985,203; and 4,099,693 relate to support devices for use with ladders.

As far as is known, all of the support devices found in the prior art have certain limitations in adaptability and ease of use which are not found in the present invention. U.S. Pat. Nos. 2,174,891; 2,498,944; and 3,009,677; provide supports which are positioned between the upright legs of the ladder and the items placed on these supports are sometimes difficult to reach by a user of the ladder. U.S. Pat. No. 3,111,297 depends upon the use of a clamping device secured on the upright leg of the ladder to hold a support platform for objects in place on the ladder. This clamping device musg be dismantled and reassembled in order to relocate the support platform on the ladder, requiring a user to either hold the object during relocation, or place the object on another platform at the new location. U.S. Pat. Nos. 3,223,369 and 4,099,693 provide only a single support member for receiving handles and could not be used to support objects not having carrying handles. Further, their stability is dependent upon a single rod inserted into a ladder rung. In U.S. Pat. No. 3,809,351 a circular bracket for receiving and supporting a paint can or the like at the side of the ladder is provided. Support is dependent upon the single bracket which hooks around the exterior of a ladder rung. The container is supported by a circular bracket which surrounds the container and engages the handle thereof at the points where the handle is attached to the container. This device is therefore suitable only for supporting paint cans or the like of a given diameter.

In U.S. Pat. No. 3,822,846, a single independent mounting member must be inserted and locked into a rung of the ladder before insertion of the mounting means for the support tray. Such an assembly would require the use of both hands and considerable effort to relocate. In U.S. Pat. No. 3,822,847 a support tray is provided for use on the right side of the ladder only, and is not easily adjustable to maintain desired horizontal orientation of the tray through various angles of inclination of the ladder. In U.S. Pat. No. 3,985,203 a side safety support step or landing for a user stepping from a ladder to a roof or window of a building is provided, but support for the user's weight must come from the building structure.

In summary, many of the known devices are inconveniently located between the upright legs of the ladder, some are limited to use with paint cans only, while others are cumbersome to relocate from one level on the ladder to another.

SUMMARY OF THE INENTION

In contrast to the foregoing, the present invention provides a stable support device usable on either side of a ladder which is easily relocated and adjustable to accomodate ladders of varying rung spacing and varying angles of ladder inclination. Briefly, the present invention provides a new and improved utility support device for use in conjunction with hollow-rung ladders. The device is removably mounted to the ladder utilizing two mounting studs which are inserted into different rungs of a ladder. A platform tray support member suitable for supporting tools, paint, materials or the like is mounted to the ladder on a first mounting stud and is supported by a brace means connected between the support member and a second mounting stud. Utilization of two mounting studs in conjunction with the support brace provides a platform of improved stability, which may be used on either side of the ladder, and which is easily mounted and dismounted.

BRIEF DESCRIPTION OF THE DRAWINGS

FIGS. 1 and 3 are front and side elevations, respectively, of another embodiment of a support device according to the present invention in position on a ladder.

FIG. 2 is a top view of a support device according to the present invention in position on a ladder.

DESCRIPTION OF THE PREFERRED EMBODIMENT

Figure 4:
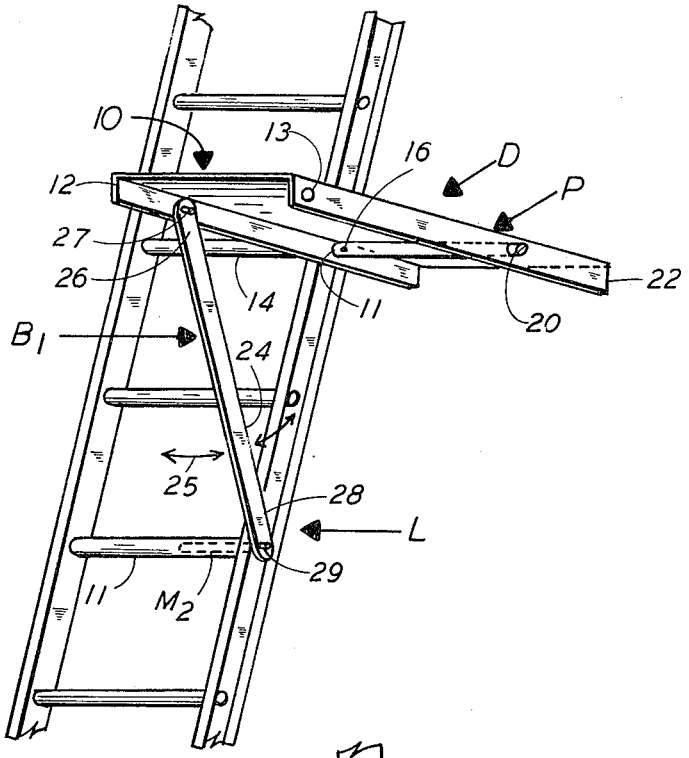
FIG. 4 is an isometric view of a support device according to the present invention shown in position on a ladder.

In the drawings, the letter D designates a utility support device according to the present invention for use with a hollow-rung ladder L. The device may be constructed of any material suitable for support such as aluminum, lightweight steel, high impact molded plastic or the like, with lightweight materials of relatively high flexural strength being preferable. The device D includes a support member P, a first mounting means or stud M-1, a second mounting means or stud M-2, and a brace means B (FIG. 1).

Considering the device D in greater detail, the support member P (FIG. 1) is in the form of a flat rectangular platform tray 10 with downwardly extending side flanges 12 and 22 for attaching tray 10 to the other members of device D. The tray may be used to support tools, containers for paint, materials or the like. Although shown in the drawings as rectangular, it should be understood that the support member may be designed in other shapes to suit a particular support requirement. For example, the support member may be an essentially flat tray with circular recesses adapted for receiving paint containers, or a rigid arm with a hook adapted for receiving a handle for a can or other container as will be set forth below.

The mounting means M-1 is in the form of a tubular stud adapted for insertion into a first hollow ladder rung 14 (FIG. 1). It has been found that for best results, stud M-1 should extend into rung 14 approximately one-fourth to one-half the width of the ladder L. Stud M-1 extends through hole 11 in flange 12 of support member P and is secured thereto by cotter pins 16 and 18, thereby preventing tray 10 from sliding laterally along stud M-1 (FIG. 4). Stud M-1 may extend across the width of tray 10 and engage support member P at a second hole 20 in flange 22. This configuration provides further support to the outer edge of tray 10 which is away from the ladder L.

Figure 6:
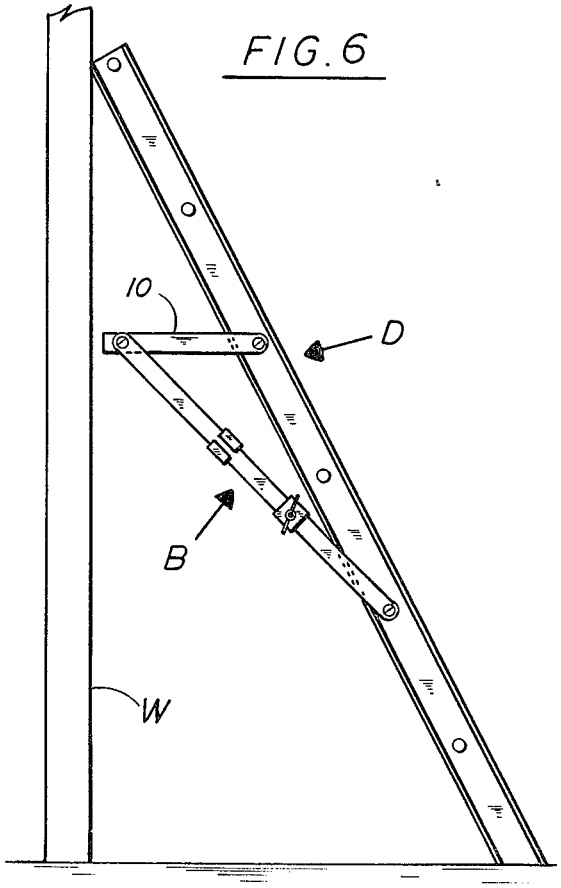
FIG. 6 is a side elevation of a support device according to the present invention in position on the alternate side of a ladder.

The device D may be mounted on the left side without alteration, which will result in the tray 10 extending from the ladder L toward the wall W (FIG. 6), or the device D may be adapted to position the tray 10 to extend outwardly from ladder L away from the wall in the same manner as when the device is used on the rignt side of the ladder L (FIG. 3). This is accomplished by removing stud M-1 from tray 10, and then reinserting stud M-1 from the opposite side of tray 10 through hole 20 in flange 22 and then through hole 11 in flange 10. It is understood that the cotter pins in holes 16 and 18 would be removed and reinserted to secure tray 10 to stud M-1. Next, brace means B is detached from tray 10 by removing the attachment means 27, and then reattached to tray 10 via the same attachment means 27 at hole 13 in flange 22, insuring that stud M-2 is positioned to extend to the same side of device D as does stud M-1. The above procedures result in a mirror image embodiment of device D, suitable for use on the left side of a ladder.

Brace means B (FIG. 1) includes an arm 24 connected at a first end 26 to flange 12 of support member P and at a second end 28 to stud M-2. Brace means B provides support to tray 10, preventing tray 10 from rotating about the axis of stud M-1. For ease of use with ladders of varying rung spacing, it is preferable that arm 24 of the brace means B be pivotally connected to flange 12 of said support member P at end 26 with pin 27 or other suitable means therby allowing arm 24 to pivot in the manner shown by the arrows 25 in FIG. 4. Alternatively, (FIGS. 3 and 4) brace means B may be comprised of telescoping arms 30 and 32 provided with coupling members 34 and 36 respectively. Member 34 is adapted for receiving arm 30 and member 36 is adapted for receiving arm 32. In such a configuration arms 30 and 32 together form a telescoping brace member capable of adjusting in length in the manner shown by arrows 35 in FIG. 3. The length of telescoping member is fixed as desired by tightening a winghead screw 38 provided in coupling member 34 which, when tightened, engages arm 32 (FIG. 3). It is understood that other manner or means of providing an adjustable length brace means B may also be used. The adjustable feature of brace means B coupled with the pivotal connection of arm 30 to said support member P at end 26 makes the device D more suitable for use with ladders of varying rung spacing and enables the user to maintain a substantially horizontal orientation of said support member P for a wide number of angles of inclination 40 of the ladder L with respect to an adjacent wall W (FIG. 3).

Mounting means M-2 is shown in phantom as a tubular stud suitable for insertion into a second hollow ladder rung 42, coplanar with stud M-1 along the longitudinal axis of the ladder L. Stud M-2 is connected to said brace means B at end 28 by pin 29, but it is understood such connection may also be a machine bolt, rivet or, other suitable mounting means (FIG. 1). This connection may also be pivotal so as to allow arms 24 or 32 to pivot about the connection at end 28 (FIGS. 1 and 4).

Brace means B may also be connected to said support member P at end 26 so that the angle 44 between them may be adjusted (FIG. 3). This is accomplished by providing a wing head screw 46 (FIG. 1) which threads onto pin 27 which, when tightened, fixes the angle 44, thereby preventing brace means B from rotating with respect to P about pin 27. With the angle 44 so fixed, a user may hold materials being supported by tray 10 with one hand, while removing the device D from the ladder L with the other. The user may then easily remount the device D at a different level on the ladder since the component parts of device D have maintained their relative positions, thereby allowing studs M-1, and M-2 to be easily inserted into two different ladder rungs.

Figure 5:
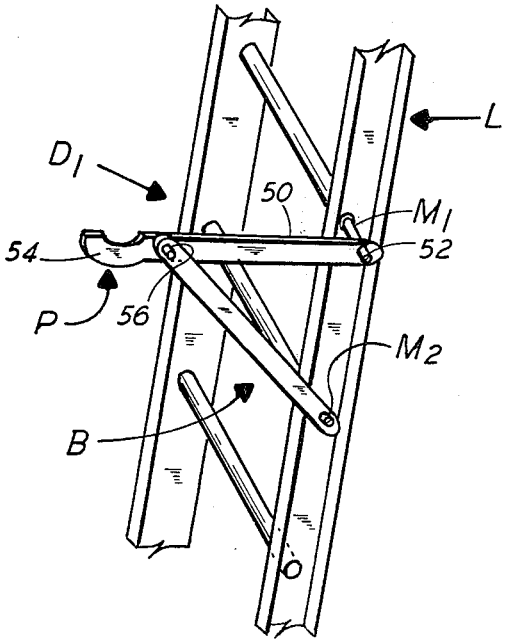
FIG. 5 is a side elevation of another embodiment of a support device according to the present invention in position on a ladder.

An alternate embodiment D-1 of the present invention is shown in FIG. 5. There, the support member P is in the form of a rigid bar 50 mounted to the ladder by stud M-1 on end 52 and having a hook 54 on the opposite end. Such a configuration is adapted for receiving and holding a handle for a can or other container. Support member P is supported by brace means B at point 56.

The foregoing disclosure and description of the invention are illustrative and explanatory thereof, and various changes in the size, shape and materials as well as in the details of the illustrated construction may be made without departing from the spirit of the invention.

I claim:

1. A utility support device for use with a hollow rung ladder for supporting paint containers, materials, tools or the like at a side of a leg of the ladder comprising:

a support member;

an inflexible brace member, having a first end and a second end, connected to said support member at said first end and movable to various angular positions with respect to said support member;

a first mounting means connected to said support member and extending therefrom, adapted for providing a support mounting for said support member at the side of the ladder leg by engaging a first hollow rung of the ladder;

a second mounting means connected to said brace means at said second end, extending therefrom in a plane substantially parallel to said first mounting means, and adapted for providing a support mounting for said brace member at the side of the ladder by engaging a second hollow rung of the ladder;

means for selectively fixing the angular position of said brace member with respect to said support member; and wherein said brace member is adapted for preventing said support member from pivoting around the axis of said first mounting means, and said first and second mounting means are substantially coplanar with the longitudinal axis of the ladder to provide a stable, substantially horizontal support device.

2. The device of claim 1 wherein said brace member comprises an adjustable length arm with means for adjustably fixing the length thereof so that the device may be used with ladders of varying rung spacing and so that said support member may be maintained in an substantially horizontal plane through various angles of inclination of the ladder.

3. The device of claim 1, wherein said support member is a platform tray.

4. The device of claim 3, wherein said first mounting means extends substantially across the width of said support member.

5. The device of claim 1, wherein said support member is a rigid rod with a hook formed in the end away from the ladder suitable for receiving and holding the handle of a paint can.

6. The device of claim 1 wherein said brace member is pivotally connected to said support member.

7. The device of claim 1, wherein said first and second mounting means are tubular cylindrical rods for insertion into the hollow ladder rungs.

8. The device of claim 1, wherein said brace member is pivotally connected to said second mounting means.

9. The device of claim 1 wherein said first mounting means is pivotally connected to said support means.

* * * * *

UNITED STATES PATENT AND TRADEMARK OFFICE

CERTIFICATE OF CORRECTION

PATENT NO. : 4,318,523

DATED : March 9, 1982

INVENTOR(S) : Michael A. Weatherly

It is certified that error appears in the above-identified patent and that said Letters Patent are hereby corrected as shown below:

On the title page at "Assignee:"

delete "Howard E. Stuller" and
insert "Howard C. Sanford"

Signed and Sealed this

*Fifteenth* Day of *June 1982*

[SEAL]

*Attest:*

GERALD J. MOSSINGHOFF

*Attesting Officer*

*Commissioner of Patents and Trademarks*